US006736787B1

(12) United States Patent
McEwen et al.

(10) Patent No.: US 6,736,787 B1
(45) Date of Patent: May 18, 2004

(54) APPARATUS FOR APPLYING PRESSURE WAVEFORMS TO A LIMB

(76) Inventors: James Allen McEwen, 10551 Bamberton Dr., Richmond, B.C. (CA), V7A 1K6; Michael Jameson, 2365 Badger Road, North Vancouver, B.C. (CA), V7G 1S9

( * ) Notice: Subject to any disclaimer, the term of this patent is extended or adjusted under 35 U.S.C. 154(b) by 0 days.

(21) Appl. No.: 09/676,925

(22) Filed: Oct. 2, 2000

Related U.S. Application Data

(63) Continuation of application No. 09/105,393, filed on Jun. 26, 1998, now abandoned, which is a continuation-in-part of application No. 08/639,782, filed on Apr. 29, 1996, now Pat. No. 5,843,007.

(51) Int. Cl.[7] ..... A61H 1/00; A61H 1/02; A61H 5/00

(52) U.S. Cl. ..... 601/152

(58) Field of Search ..... 601/148–149, 601/150–152, 41; 602/13; 606/201, 20; 128/DIG. 20

(56) References Cited

U.S. PATENT DOCUMENTS

| | | | | |
|---|---|---|---|---|
| 3,892,229 | A | | 7/1975 | Taylor et al. |
| 3,942,518 | A | | 3/1976 | Tenteris et al. |
| 4,013,069 | A | | 3/1977 | Hasty |
| 4,331,133 | A | | 5/1982 | Arkans |
| 4,375,217 | A | | 3/1983 | Arkans |
| 4,396,010 | A | | 8/1983 | Arkans |
| 4,408,599 | A | | 10/1983 | Mummert |
| 4,419,988 | A | | 12/1983 | Mummert |
| 4,469,099 | A | | 9/1984 | McEwen |
| 4,718,427 | A | * | 1/1988 | Russell ..... 128/679 |
| 4,841,956 | A | | 6/1989 | Gardner et al. |
| 4,867,140 | A | | 9/1989 | Hovis et al. |
| 4,883,462 | A | | 11/1989 | Williamson et al. |
| 5,007,411 | A | | 4/1991 | Dye |
| 5,022,387 | A | | 6/1991 | Hasty |
| 5,031,604 | A | | 7/1991 | Dye |
| 5,048,533 | A | | 9/1991 | Muz |

(List continued on next page.)

FOREIGN PATENT DOCUMENTS

| | | |
|---|---|---|
| WO | WO93/12708 | 7/1993 |
| WO | WO95/18594 | 7/1995 |
| WO | WO95/22307 | 8/1995 |
| WO | WO95/26705 | 10/1995 |

OTHER PUBLICATIONS

McEwen JA, Masri BA, Nakane JJ, Duncan CP. *Variations In Delivered Pneumatic Compression Therapy For OVT Prophylaxis May Significantly Affect Reported Patient Outcomes*. Proc 24 Can Med Biol Eng Conf 1 9984, 2 pages (Abstract).

(List continued on next page.)

*Primary Examiner*—Jerome W. Donnelly
(74) *Attorney, Agent, or Firm*—ipsolon llp

(57) ABSTRACT

Apparatus for applying pressure to a patient's limb in order to augment venous blood flow in the limb and for monitoring the applied pressure, includes supplying a gas at a varying supply pressure to an inflatable sleeve that fits onto a limb to apply a varying pressure to the limb beneath the sleeve when inflated with the gas. A pressure transducer measures the pressure of gas in the inflatable sleeve and produces a sleeve pressure signal indicative of the estimated level of pressure. The apparatus measures the value of a predetermined pressure waveform parameter and produces a waveform parameter signal indicative of the measured value of the predetermined pressure waveform parameter. An interval signal is produced as indicative of an interval between a first occurrence when the measured value of the predetermined pressure waveform parameter is near a predetermined parameter level and the next occurrence when the measured value of the predetermined pressure waveform parameter is near the predetermined parameter level.

21 Claims, 9 Drawing Sheets

U.S. PATENT DOCUMENTS

| | | | | |
|---|---|---|---|---|
| 5,254,087 | A | | 10/1993 | McEwen |
| 5,307,791 | A | | 5/1994 | Senoue et al. |
| 5,437,610 | A | | 8/1995 | Cariapa et al. |
| 5,439,477 | A | | 8/1995 | McEwen |
| 5,443,440 | A | * | 8/1995 | Tumey et al. ..... 601/152 |
| 5,575,762 | A | | 11/1996 | Peeler et al. |
| 5,607,447 | A | | 3/1997 | McEwen et al. |
| 5,669,872 | A | | 9/1997 | Fox |
| 5,815,864 | A | | 10/1998 | Sloop |
| 5,876,359 | A | | 3/1999 | Bock et al. |

OTHER PUBLICATIONS

Comerota AJ, Katz, ML, White, JV, White Why Does Prophylaxis With External Pneumatic Compression for Deep Vein Thrombosis Fail? *Amer. Journ of Sur*. V 164 pp. 265–268 Sep. 1992.

Westrich GH, Sculco TP. Prophylaxis Against Deep Vein Thrombosis After Total Knee Arthroplasty. *J Bone Joint Surg* [*Am*] 1996; 78–A: 826–8 34.

Jacobs DG, Piotrowski JJ, Hoppensteadt DA, Salvator AE, Fareed J. Hemdynamic And Fibrinolytic Consequences Of Intermittent Pneumatic Compression: Preliminary Results. *J Trauma* 1996; 40: 710–716.

Olson DA, Kamm RD. Shapiro AH. *Bioengineering Studies Of Periodic External Compression As Prophylaxis Against Deep Vein Thrombosis—Part II: Experimental Studies On A Simulated Leg*. Transactions of the ASME 1982; 104: 96.

Kamm R, Butcher R, Froelich J, Johnson M, Salzman E, Shapiro A, Strauss HW. *Optimisation of Indices of External Pneuamatic Compression for Prophylaxis Against Deep Vein Thrombosis*: Radionuclide Gated Imaging Studies. Cardiovasc Res 1986: 20: 588–596.

Nicolaides AN, Fernandes e Fernandes J, Pollock AV. *Intermittent Sequential Pneumatic Compression of the Legs in the Prevention of Venous Stasis and Postoperative Deep Venous Thrombosis*. Surgery 1980; 87: 69–75.

Jobst Athrombic Pump System 2500; Jobst Medical Canada, Inc.; 4–page product brochure; Jan. 1994.

Comerota, AJ et al; *The Fibrinolytic Effects of Intermittent Pneumatic Compression*, Annals of Surgery, V 226, No. 3; pp. 306–314 circa Jan. 1997.

* cited by examiner

APPARATUS FOR APPLYING PRESSURE WAVEFORMS TO A LIMB

This is a continuation of U.S. patent application Ser. No. 09/105,393, filed Jun. 26, 1998 now abandoned, which is a continuation-in-part of U.S. patent application Ser. No. 08/639,782 filed Apr. 29, 1996 now U.S. Pat. No. 5,843,007.

FIELD OF THE INVENTION

The invention is related to an apparatus and method for applying varying pressure waveforms to a limb of a human patient in order to help prevent deep vein thrombosis (DVT), pulmonary embolism (PE) and death.

BACKGROUND OF THE INVENTION

Limb compression systems of the prior art apply and release pressure on a patient's extremity to augment venous blood flow and help prevent deep vein thrombosis (DVT), pulmonary embolism (PE) and death. Limb compression systems of the prior art typically include: a source of pressurized gas; one or more pneumatic sleeves for attaching to one or both of the lower limbs of a patient; and an instrument connected to the source of pressurized gas and connected to the sleeves by means of pneumatic tubing, for controlling the inflation and deflation of the sleeves and their periods of inflation and deflation. In U.S. Pat. No. 3,892,229 Taylor et al. describe an early example of one general type of limb compression system of the prior art known as an intermittent limb compression system; such systems apply pressure intermittently to each limb by inflating and deflating a single-bladder sleeve attached to the limb. In U.S. Pat. No. 4,013,069 Hasty describes an example of a second general type of limb compression system of the prior art, known as a sequential limb compression system; such systems apply pressure sequentially along the length of the limb by means of a multiple-bladder sleeve or multiple sleeves attached to the same limb which are inflated and deflated at different times. Certain intermittent and sequential limb compression systems of the prior art are designed to inflate and deflate sleeves thereby producing pressure waveforms to be applied to both limbs either simultaneously or alternately, while others are designed to produce pressure waveforms for application to one limb only.

One major concern with all pneumatic limb compression systems of the prior art is that the therapy actually delivered by these systems may vary substantially from the expected compression therapy. For example, a recent clinical study designed by one of the inventors of the present invention, and involving the most commonly used sequential pneumatic limb compression systems of the prior art, showed that the pneumatic limb compression therapy actually delivered to 49 patients following elective total hip replacement surgery varied widely from therapy expected by the operating surgeons in respect of key parameters of the therapy shown in the clinical literature to affect patient outcomes related to the incidence of deep venous thrombosis, pulmonary embolism and death. The study methodology involved continuous monitoring of the varying pressure of the compressed air in the pneumatic sleeves of these systems, permitting the values of key parameters of pneumatic compression therapy actually delivered to patients to be directly monitored throughout the prescribed period of therapy and compared to the expectations of operating surgeons. The results of this clinical study indicated that the expected therapy was not delivered to any of the 49 patients monitored: therapy was only delivered an average of 77.8 percent of the time during the expected periods of therapy; the longest interruptions of therapy in individual subjects averaged 9.3 hr; and during 99.9 percent of the expected therapy times for all 49 patients monitored in the study, values of key outcomes-related parameters of the therapy actually delivered to the patients varied by more than 10 percent from desired values. These parameters included rates of pressure rise and maximum pressures actually delivered through the sleeves. The unanticipated range of variations that was found in this clinical study between expected and delivered pneumatic compression therapy, within individual patients and across all patients, may be an important source of variations in patient outcomes in respect of the incidence of deep vein thrombosis, pulmonary embolism and death, and may be an important confounding variable in comparatively evaluating reports of those patient outcomes. The present invention addresses many of the limitations of prior-art systems that have led to such unanticipated and wide variations between the expected therapy and the therapy actually delivered to patients.

Due to errors and limitations associated with estimation of the pressure applied by a sleeve to a limb, prior-art systems have not had the capability of accurately producing a desired pressure waveform in combination with sleeves having differing designs and varying pneumatic volumes, or when sleeve application techniques vary and the resulting sleeve snugness varies, or when sleeves are applied to limbs of differing sizes, shapes and tissue characteristics. As a result, substantial variations often arise between the desired and actual pressure waveforms delivered by limb compression systems of the prior art.

Many limb compression systems of the prior art are not capable of producing a desired pressure waveform in a pneumatic sleeve attached to a limb under varying operational and clinical circumstances such as movement of the limb, movement of the sleeve relative to the limb and varying snugness of sleeve application, in part because they do not generate a signal indicative of the actual pressure in the sleeve suitable for permitting a feedback control system to produce the desired pressure waveform. Some limb compression systems known in the prior art attempt to estimate sleeve pressure in an inexpensive and convenient manner, based on a variety of apparatus and methods. These systems do not measure pressure directly in the pneumatic sleeve applied to the limb but instead estimate sleeve pressure indirectly and remotely from the sleeve. For example, in U.S. Pat. No. 5,031,604 Dye describes a system in which sleeve pressure is estimated by measuring pneumatic pressure near the instrument end of the tubing connecting the instrument to the sleeve. As another example, Arkans in U.S. Pat. No. 4,375,217 describes a system in which the static pressure in the sleeve is estimated at a location on the tubing between the instrument and the sleeve. All such apparatus and methods which estimate sleeve pressure by measuring a pneumatic pressure remotely from the sleeve suffer from a significant disadvantage, which makes them unsuitable for incorporation into an instrument for producing a desired pressure waveform in the sleeve: the accuracy of the estimates of pressure made by such systems is significantly affected by variations in the length and flow resistance of the tubing attached to the sleeve, and by variations in sleeve design, sleeve inflation volume and sleeve application technique. For example, the inventors of the present invention have determined that variables related to the design and size of the sleeve, as well as the snugness of application of the sleeve, can result in discrepancies at any instant of well over 50 percent between the remotely estimated sleeve pressure and the actual pressure in the sleeve. As a separate consideration regarding the flow resistance of the tubing employed in prior-art systems which measure pressure in this manner, it has been necessary to locate such systems close to the patient to minimize flow resistance in the tubing, resulting in unnecessary noise and clutter around the patient.

Other systems known in the prior art interrupt the flow of gas in the tubing in an effort to estimate sleeve pressure by measuring pneumatic pressure at the instrument end of the tubing under zero-flow conditions. One such system is the Jobst Athrombic Pump System 2500 (Jobst Institute Inc., Charlotte N.C.). However, estimates of sleeve pressure made in this manner cannot practically be incorporated into limb compression systems for producing pressure waveforms having large amplitudes and short cycle periods. Also, more generally, such systems suffer from the disadvantage that pressure estimates are available discontinuously and are not suitable for real-time control of the pressure in the sleeve to produce a desired pressure waveform.

Some limb compression systems of the prior art attempt to record and display the total cumulative time during which pneumatic compression therapy was delivered to a patient's limb, but do not differentiate between times when values of parameters of the delivered therapy were near the desired values for the therapy and when they were not. For example, commercially available systems such as system the Plexipulse intermittent pneumatic compression device (NuTech, San Antonio Tex.) and AirCast intermittent pneumatic compression device (Aircast Inc., Summit, N.J.) record the cumulative time that compressed air was delivered to each compression sleeve. These are typical of prior-art systems which include simple timers that record merely the cumulative time that the systems were in operation.

In U.S. Pat. No. 5,443,440 Tumey et al. describe a pneumatic limb compression system capable of recording compliance data by creating and storing the time, date and duration of each use of the system for subsequent transmission to a physician's computer. The compliance information recorded by this system contains only information relating to times when the system was operating and the cumulative duration of operation. Tumey et al. cannot and does not determine occurrences when pressure-related values of parameters of the delivered therapy matched the desired values of the parameters and occurrences when they did not.

A major limitation of Tumey et al. and other limb compression systems of the prior art is that values of key parameters of pneumatic compression therapy that are known to affect patient outcomes are not monitored and recorded. This is a serious limitation because evidence in the clinical literature shows that variations in applied pressure waveforms produce substantial variations in venous blood flow, and that delays and interruptions in the delivery of pneumatic compression therapy affect the incidence of DVT. One key parameter identified by the inventors of the present invention is the interval between successive occurrences of delivered pressure waveforms having desired values of certain waveform parameters known to affect patient outcomes, such as rate of pressure rise and maximum pressure. Because this key parameter is not monitored as therapy is delivered by prior-art systems, variations between delivered and expected therapy cannot be detected as they occur, and clinical staff and patients cannot be alerted to take corrective measures for improving therapy and patient outcomes.

Because prior-art systems do not monitor the interval between successive occurrences of delivered pressure waveforms having desired values of certain waveform parameters known to affect patient outcomes, and because such prior-art systems do not therefore have alarms to alert clinicians and patients that a maximum time interval has elapsed during which the expected therapy was not delivered to the patient, then the operator and the patient cannot adapt such systems during therapy, including for example sleeve re-application and changing certain parameters of therapy, to help assure that the prescribed and expected therapy is actually delivered to the patient throughout as much as possible of the prescribed duration of therapy.

In addition to the monitoring limitations of prior-art systems described above, prior art systems do not measure and record parameters related to the application of a desired pressure waveform, such as any differences between the actual shape of the pressure waveform produced in the pneumatic sleeve and the shape of a desired reference pressure waveform, the times during which a waveform matching a desired waveform in respect of key parameters was periodically applied, the interval between applications of waveforms matching a desired waveform and the number of cycles of the waveform which were applied.

Additionally, limb compression systems do not subsequently produce the recorded values of key outcomes-related parameters for use by physicians and others in determining the extent to which the prescribed and desired pressure waveforms were actually applied to the patient for use by third-party payors in reimbursing for therapy actually provided, and for use in improving patient outcomes by reducing variations in parameters of therapy known to produce variations in patient outcomes.

SUMMARY OF THE INVENTION

The present invention provides apparatus and a method for applying pressure to a patient's limb through a pneumatic sleeve in order to augment venous blood flow in the limb and for monitoring the applied pressure, to help prevent deep vein thrombosis, pulmonary embolism and death. More specifically, the present invention includes means for supplying a gas at a varying supply pressure, an inflatable sleeve adapted for positioning onto a limb to apply a varying pressure to the limb beneath the sleeve when inflated with the gas, pressure transducing means for measuring the pressure of gas in the inflatable sleeve, waveform parameter measurement means for measuring the value of a predetermined pressure waveform parameter, and interval determination means for producing an indication of the interval between two occurrences when the measured value of the predetermined pressure waveform parameter is near a predetermined parameter level.

In the present invention, the pressure waveform parameter can be a predetermined variation in the measured level of pressure of gas in the sleeve that augments the flow of venous blood into the limb proximal to the sleeve from the limb beneath the sleeve. Also, the sleeve of the present invention can include two ports and separate tubing connecting it to the gas supply means and the pressure transducing means so that the pressure transducing means only communicates pneumatically with the gas supply means through the sleeve.

The present invention includes means to allow an operator to select the predetermined pressure waveform parameter and the predetermined parameter level from a plurality of predefined parameters and parameter levels. Also, alarm means are included for producing an indication perceptible to the operator and the patient when the determined interval exceeds a predetermined maximum interval.

The interval determination means of the present invention can include means for measuring a number of intervals during therapy, each corresponding to the time between an occurrence when the measured value of the parameter is near the predetermined parameter level and the next occurrence when the measured value of the parameter is near the predetermined parameter level. The interval determination means can further include a clock for determining the clock times when occurrences are measured.

DETAILED DESCRIPTION OF THE PREFERRED EMBODIMENT

The embodiment illustrated is not intended to be exhaustive or limit the invention to the precise form disclosed. It is chosen and described in order to explain the principles of the invention and its application and practical use, and thereby enable others skilled in the art to utilize the invention.

In the context of the preferred embodiment, a pressure waveform is generally considered to be a curve that represents the desired or actual amplitude of pressure in a pneumatic sleeve applied to a patient over time, and is described by a graph in rectangular coordinates whose abscissas represent times and whose ordinates represent the values of the pressure amplitude at the corresponding times. A cycle time period of the pressure waveform is generally considered to be the period of time during which one desired pressure waveform is completed. A phase of the pressure waveform is generally considered to be a portion of the pressure waveform occurring during an interval of time within the cycle time period of the pressure waveform. In the context of the preferred embodiment, periodic generation of a pressure waveform is generally considered to be the repetitive production of the pressure waveform in a pneumatic sleeve applied to a patient.

The preferred embodiment of the invention is described in three sections below: instrumentation, software and sleeves.

I. Instrumentation

Figure 1:
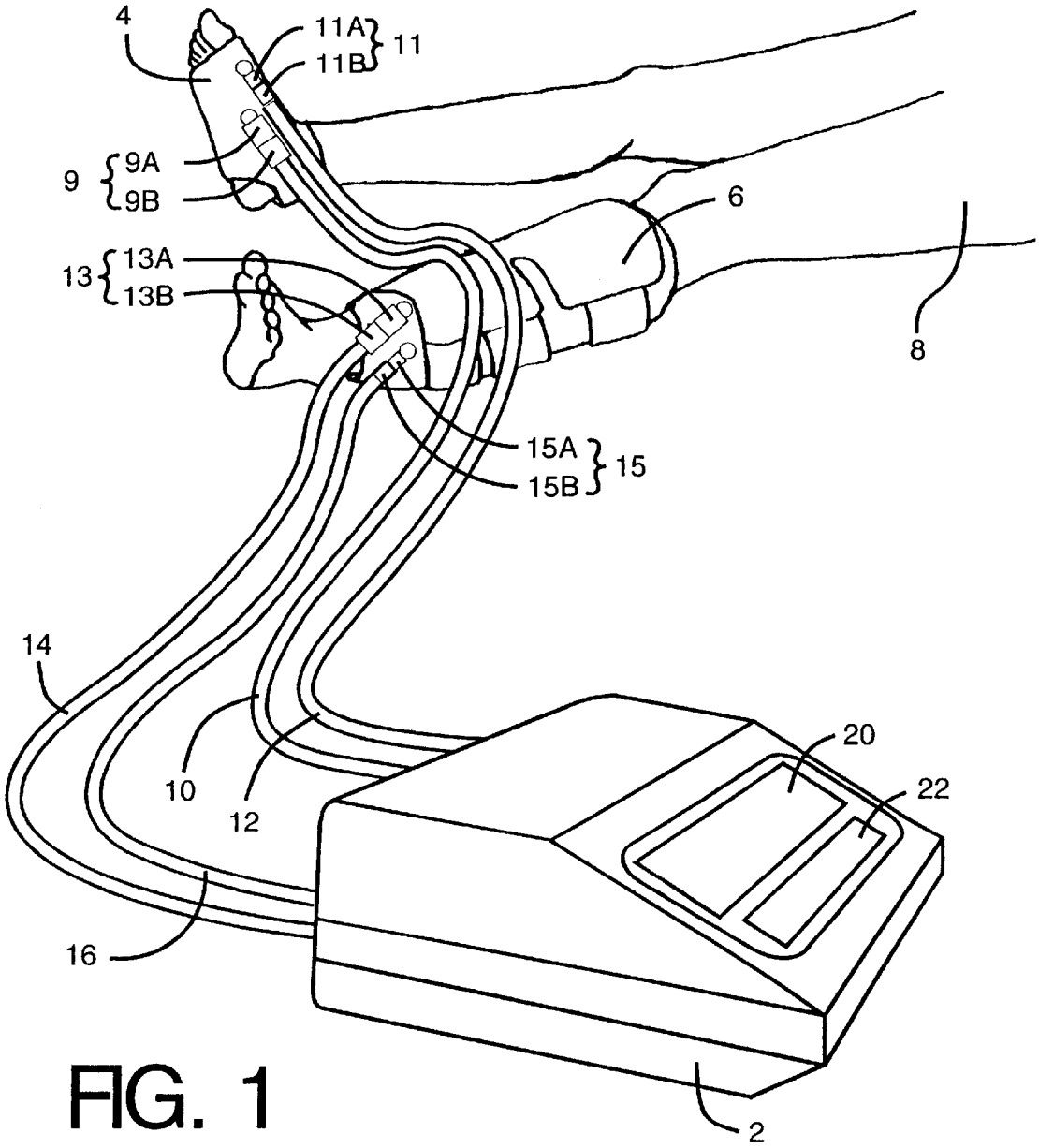
FIG. 1 is a pictorial representation of the preferred embodiment in a typical clinical application.

FIG. 1 depicts instrument 2 connected to two inflatable sleeves, foot sleeve 4 and calf sleeve 6. Foot sleeve 4 is suitable for applying a compressive pressure waveform to the plantar region of the foot, and is depicted applied to the right foot of a patient 8. Foot sleeve 4 is shown in detail in FIGS. 8 and 9 and described further below. Calf sleeve 6 is suitable for applying a compressive pressure waveform to the calf and is depicted applied to the left calf of patient 8. Calf sleeve 6 is shown in detail in FIGS. 10 and 11 and is also described below. Alternatively, other designs of sleeves, applied to other regions of the lower or upper limb, may be employed. Instrument 2 has two channels, channel "A" and channel "B". Inflatable sleeves 4 and 6 applied to patient 8 are connected to channels "A" and "B" of instrument 2. Instrument 2 repetitively produces a desired pressure waveform in foot sleeve 4 connected to channel "A" of instrument 2, and repetitively produces another desired pressure waveform in calf sleeve 6 connected to channel "B" of instrument 2, in order to augment the flow of venous blood from the portions of the limbs beneath sleeves 4 and 6 into portions of the limbs proximal to sleeves 4 and 6. Channel "A" and channel "B" of instrument 2 operate independently, and may generate different or similar pressure waveforms, as determined by an operator.

Figure 2:
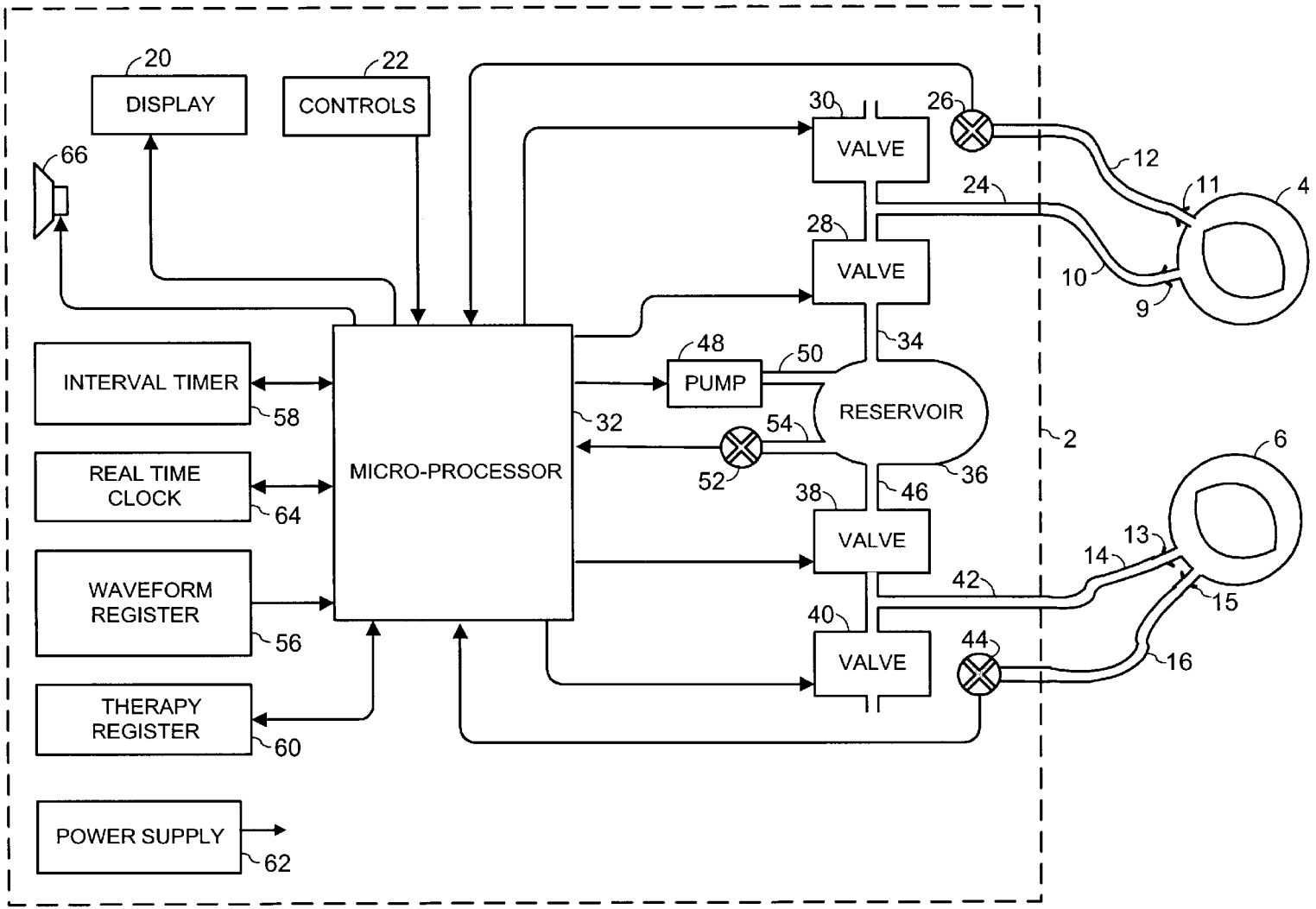
FIG. 2 is a block diagram of the preferred embodiment.

To enable a better appreciation of the versatility of the invention, instrument 2 is depicted in FIGS. 1 and 2 with channel "A" connected to foot sleeve 4 and channel "B" connected to calf sleeve 6, to apply pressures to the foot of the right leg and to the calf of the left leg of patient 8, as may be desirable during a surgical procedure. In other clinical applications, channels "A" and "B" of instrument 2 may be connected to two foot sleeves for applying pressure waveforms to each foot of a patient, or to two calf sleeves for applying pressure waveforms to each calf of a patient. Alternatively, instrument 2 may be connected to only one sleeve, or two sleeves of different design applied to the same limb for applying pressure waveforms sequentially in time.

As can be seen in FIG. 1, an inflatable portion of foot sleeve 4 communicates pneumatically with channel "A" of instrument 2 by means of pneumatic connector 9 and pneumatic tubing 10, and by means of pneumatic connector 11 and pneumatic tubing 12. Connector 9 comprises sleeve connector 9*a* non-releasably attached to foot sleeve 4 and mating tubing connector 9*b* non-releasably attached to tubing 10. Connector 11 comprises sleeve connector 11*a* non-releasably attached to foot sleeve 4 and mating tubing connector 11*b* non-releasably attached to tubing 12. In the preferred embodiment connector 9*a* is physically incompatible with connector 11*b* and does not mate with connector 11*b*. Connector 11*a* is physically incompatible with connector 9*b* and does not mate with connector 9*b*.

An inflatable portion of calf sleeve 6 communicates pneumatically with channel "B" of instrument 2 by means of pneumatic connector 13 and pneumatic tubing 14, and by means of pneumatic connector 15 and pneumatic tubing 16. Connector 13 comprises sleeve connector 13*a* non-releasably attached to calf sleeve 6 and mating tubing connector 13*b* non-releasably attached to tubing 14. Connector 15 comprises sleeve connector 15*a* non-releasably attached to calf sleeve 6 and mating tubing connector 15*b* non-releasably attached to tubing 16. In the preferred embodiment connector 13*a* is physically incompatible with connector 15*b* and does not mate with connector 15*b*. Connector 15*a* is physically incompatible with connector 13*b* and does not mate with connector 13*b*.

Liquid crystal graphic display 20 shown in FIGS. 1 and 2 forms part of instrument 2 and is used to display information to the operator of instrument 2. Display 20 is employed for the selective presentation of any of the following information as described below: (a) menus of commands for controlling instrument 2, from which an operator may make selections; (b) parameters having values which characterize the sleeve pressure waveforms to be produced in inflatable sleeves connected to channels "A" and "B" of instrument 2; (c) text messages describing current alarm conditions, when alarm conditions are determined by instrument 2; (d) graphical and text representations of the time intervals between the production of pressure waveforms having desired predetermined parameters in inflatable sleeves connected to channels "A" and "B" of instrument 2; (e) messages which provide operating information to the operator.

Controls 22 shown in FIGS. 1 and 2 provide a means for an operator to control the operation of instrument 2.

Referring the block diagram of instrument 2 depicted in FIG. 2, foot sleeve 4 communicates pneumatically with valve manifold 24 through pneumatic connector 9 and pneumatic tubing 10. Foot sleeve 4 also communicates pneumatically with pressure transducer 26 through pneumatic connector 11 and pneumatic tubing 12. Valve 28 and valve 30 communicate pneumatically with manifold 24. Valve 28, valve 30, manifold 24 and pressure transducer 26 comprise the principal pneumatic elements of channel "A" of instrument 2.

In the preferred embodiment valve 28 is an electrically actuated, normally closed, proportional valve and valve 30 is an electrically actuated, normally open, proportional valve. Valves 28 and 30 respond to certain valve control signals generated by microprocessor 32. The level of the valve control signals presented to each of valves 28 and 30 by microprocessor 32 determines the degree to which valve 28 opens and the degree to which valve 30 closes. The level of the valve control signals thereby affects the pressure of gas in foot sleeve 4 by changing the rate of gas flow into and out of manifold 24.

Pressure transducer 26 communicates pneumatically with the inflatable portion of foot sleeve 4 by means of tubing 12 and connector 11. As shown in FIGS. 1 2 pressure transducer 26 does not communicate pneumatically with valve manifold 24 except through foot sleeve 4. In this way, pressure transducer 26 directly and continuously measures the pressure of gas in the inflatable portion of foot sleeve 4, irrespective of variables including the flow resistance of tubing 10, the flow resistance of connector 9, the design of foot sleeve 4, the pneumatic volume of the inflatable portion of foot sleeve 4, and the snugness of application of foot sleeve 4 to the limb of patient 8. Pressure transducer 26 is electrically connected to an analog to digital converter (ADC) input of microprocessor 32 and generates a channel "A" sleeve pressure signal, the level of which is representative of the pressure of gas in foot sleeve 4.

Valve 28 communicates pneumatically with manifold 24 and through tubing 34 to gas pressure reservoir 36, a sealed pneumatic chamber having a fixed volume of 750 ml. When activated valve 28 permits the flow of gas from reservoir 36 to manifold 24 and therefrom supplies pressurized gas through tubing 10 and connector 9 to the inflatable portion of foot sleeve 4. Valve 30 pneumatically connects manifold 24 to atmosphere, allowing a controlled reduction of pressure from foot sleeve 4.

Valve 38, valve 40, manifold 42 and pressure transducer 44 comprise the principal pneumatic elements of channel "B" of instrument 2, and are configured as shown in FIG. 2 and described below. Calf sleeve 6 communicates pneumatically with valve manifold 42 through pneumatic connector 13 and pneumatic tubing 14. Calf sleeve 6 also communicates pneumatically with pressure transducer 44 through pneumatic connector 15 and pneumatic tubing 16.

Valve 38 and valve 40 communicate pneumatically with manifold 42. In the preferred embodiment valve 38 is an electrically actuated, normally closed, proportional valve and valve 40 is an electrically actuated, normally open, proportional valve. Valves 38 and 40 respond to valve control signals generated by microprocessor 32. The level of the valve control signals influence the pressure of gas in calf sleeve 6 by determining the gas flow into and out of manifold 42.

Pressure transducer 44 communicates pneumatically with the inflatable portion of calf sleeve 6 by means of tubing 16 and connector 15. As shown in FIGS. 1 and 2 pressure transducer 44 does not communicate pneumatically with valve manifold 42 except through calf sleeve 6. In this way, pressure transducer 44 directly and continuously measures the pressure of gas in the inflatable portion of calf sleeve 6, irrespective of variables including the flow resistance of tubing 14, the flow resistance of connector 13, the design of calf sleeve 6, the pneumatic volume of the inflatable portion of calf sleeve 6, and the snugness of application of calf sleeve 6 to the limb of patient 8. Pressure transducer 44 is electrically connected to an analog to digital converter (ADC) input of microprocessor 32 and generates a channel "B" sleeve pressure signal, the level of which is representative of the pressure of gas in calf sleeve 6.

Valve 38 communicates pneumatically with manifold 42 through tubing 46 to gas pressure reservoir 36. When activated valve 38 permits the flow of gas from reservoir 36 to manifold 42 and therefrom supplies pressurized gas through tubing 14 and connector 13 to the inflatable portion of calf sleeve 6. Valve 40 pneumatically connects manifold 42 to atmosphere, allowing a controlled reduction of pressure from calf sleeve 6.

As shown in FIG. 2, pneumatic pump 48 communicates pneumatically with reservoir 36 through tubing 50. Pump 48 acts to pressurize reservoir 36 in response to control signals from microprocessor 32. Reservoir pressure transducer 52 communicates pneumatically with reservoir 36 through tubing 54 and generates a reservoir pressure signal indicative of the pressure in reservoir 36. Pressure transducer 52 is electrically connected to an ADC input of microprocessor 32. In response to the reservoir pressure signal and a reservoir pressure reference signal, microprocessor 32 generates control signals for pump 48 and controls the pressure in reservoir 36 to maintain a pressure near the reference pressure represented by the reservoir reference pressure signal.

Multiple predetermined reference pressure waveforms suitable for application by foot sleeve 4, and multiple predetermined pressure waveforms suitable for application by calf sleeve 6, are stored within waveform register 56.

For each reference waveform stored in waveform register 56 a corresponding set of reference values for predetermined waveform parameters is also stored in waveform register 56. The predetermined waveform parameters are representative of desired characteristics of an applied pressure waveform used to augment the flow of venous blood. For example for an individual reference waveform these waveform parameters may include: (a) the maximum pressure applied during the cycle time period; (b) the rate of rise of pressure during a portion of the reference waveform cycle time period; (c) pressure thresholds which must be exceeded for predetermined time periods. Example reference values of these parameters are: (a) 45 mmHg for maximum pressure applied during the cycle time period; (b) 10 mmHg per second rate of pressure rise maintained for a period of 3 seconds; (c) a pressure threshold of 30 mmHg exceeded for a period of 7 seconds. As described further below, microprocessor 32 uses the reference values of these waveform parameters to verify that pressure waveforms having desired characteristics have been applied to the patient.

In the preferred embodiment pressure waveforms are stored in waveform register 56 as a set of values describing the amplitude of pressure at all times within one complete waveform cycle time period. It will be apparent to those skilled in the art that certain reference pressure waveforms could alternatively be stored as series of coefficients for a mathematical equation describing the waveforms, or a scaling factor and a set of values representing a normalized waveform. Similarly the corresponding reference values of the predetermined waveform parameters could be mathematically derived from the reference pressure waveform. Waveform register 56 responds to a waveform selection signal produced as described below. The level of the waveform selection signal determines which one of the stored predetermined reference pressure waveforms and the corresponding reference values of predetermined waveform parameters will be communicated to microprocessor 32.

Figure 3:
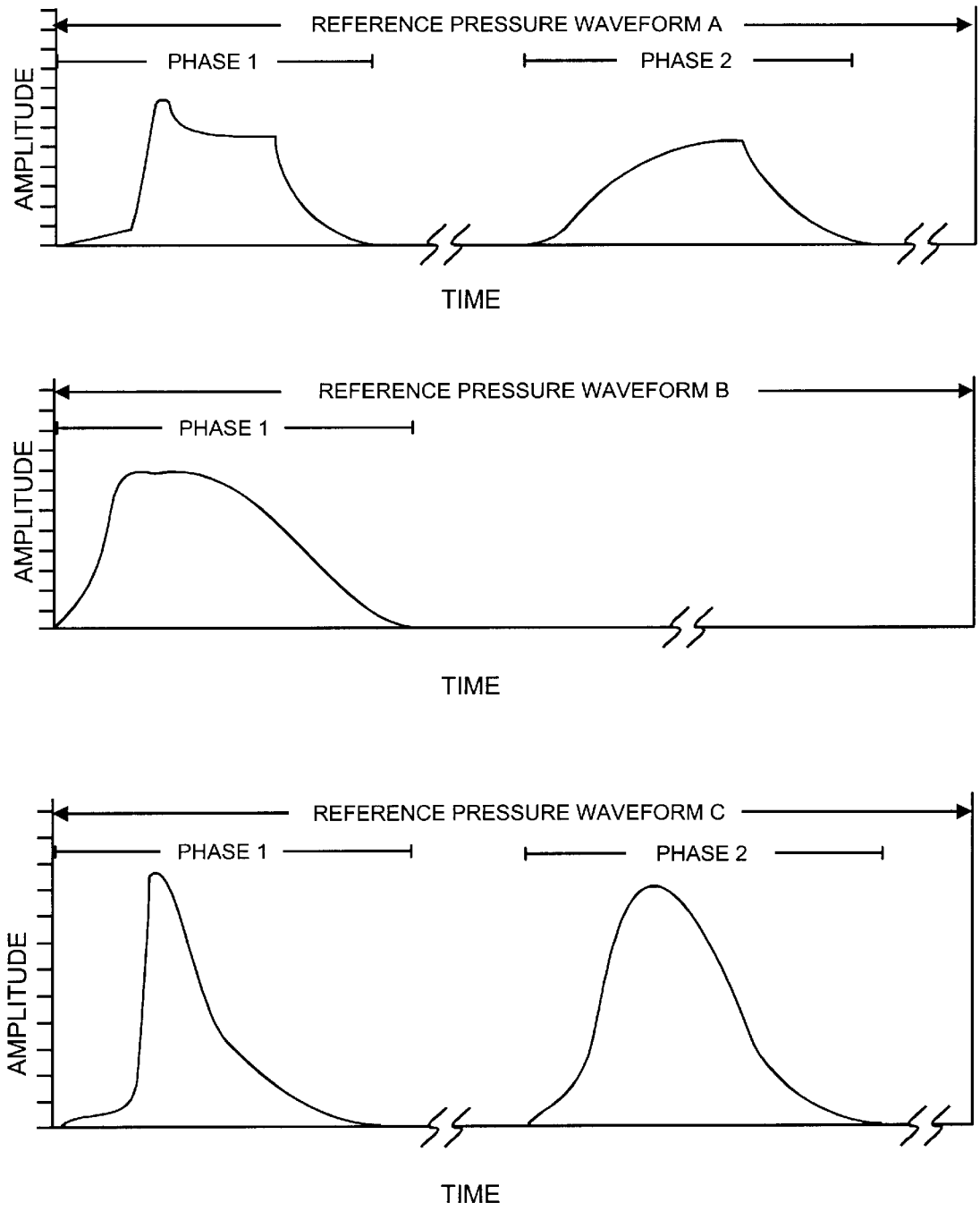
FIG. 3 are graphical representations of pressures applied to a region of a patient by the preferred embodiment

FIG. 3 illustrates three examples of reference pressure waveforms, reference pressure waveforms A, B and C, which are maintained in waveform register 56. The waveforms over the complete cycle time period are shown. Each reference pressure waveform cycle has one or more discrete phases. In the context of the preferred embodiment, a phase of a reference pressure waveform is considered to be a variation in the amplitude of pressure during a time interval within the cycle time period having a shape adapted to produce a desired augmentation of the flow of venous blood proximally from a selected sleeve which is positioned on a limb near a desired location. Reference pressure waveforms A and C illustrate waveforms having two phases. Reference pressure waveform B illustrates a reference pressure waveform having a single phase. In the preferred embodiment the cycle time periods of reference pressure waveforms range between 50 and 200 seconds. The time intervals corresponding to phases of the reference pressure waveforms range between 2 and 20 seconds.

Reference pressure waveforms A and B shown in FIG. 3 are typical waveforms for application by calf sleeve 6. Reference pressure waveform C is a typical waveform for application by foot sleeve 4. Reference pressure waveforms A and C depicted in FIG. 3 have two different phases, indicated as phase 1 and phase 2 in FIG. 3. The variation in pressure amplitude of phase 1 of each reference pressure waveform A and C shown in FIG. 3 is adapted to augment the flow of venous blood into the limb proximal to the sleeve from the limb beneath the sleeve by increasing the maximum blood velocity during the phase 1 time interval of the reference pressure waveform. The variation in pressure amplitude of phase 2 of waveforms A and C is adapted to augment the flow of venous blood into the limb proximal to the sleeve from the limb beneath the sleeve by increasing the mean blood velocity during phase 2 time interval of the waveform. Pressure waveform cycle B is shown with a single phase that is adapted to augment both mean and maximum venous blood flow proximally into the limb from the region underlying the pressurizing sleeve.

Referring again to FIG. 2, microprocessor 32 operates, when directed by an operator of instrument 2 through manipulation of controls 22, to repetitively generate a selected reference pressure waveform in foot sleeve 4 connected to channel "A" of instrument 2. Microprocessor 32 continues to repetitively produce the desired pressure waveforms in foot sleeve 4 until an operator through manipulation of controls 22 directs microprocessor 32 to suspend the generation of pressure waveforms, or alternatively until microprocessor 32 suspends the generation of pressure waveforms in response to an alarm signal as described below.

To generate pressure waveforms in foot sleeve 4 connected to channel "A", microprocessor 32 first generates a channel "A" sleeve reference pressure waveform signal by retrieving from waveform register 56 a reference pressure waveform, as determined by the level of a channel "A" waveform selection signal produced by microprocessor 32 in response to an operator manipulating controls 22.

The channel "A" sleeve reference pressure waveform signal is used by microprocessor 32, in combination with a channel "A" sleeve pressure signal generated by pressure transducer 26 and the reservoir pressure signal as described below, to maintain the pressure in the sleeve connected to channel "A" of instrument 2 near the pressure represented by the channel "A" sleeve reference pressure waveform signal by generating control signals for valves 28 and valve 30.

Microprocessor 32 subtracts the pressures represented by the levels of the channel "A" reference pressure waveform signal and the channel "A" sleeve pressure signal. The difference in pressure between the sleeve pressure and the reference waveform pressure is used by microprocessor 32 along with the pressure represented by the level of the reservoir pressure signal to calculate levels of control signals for valves 28 and 30. Valves 28 and 30 respond to the control signals to increase, decrease or maintain the pressure in foot sleeve 4 connected to channel "A" such that the pressure within foot sleeve 4 at the time is maintained near the pressure represented by the level of the channel "A" reference pressure waveform signal.

To alert the operator when the pressures being generated in foot sleeve 4 are not within a desired limit of the pressures indicated by the channel "A" reference pressure waveform signal, microprocessor 32 generates alarm signals. Microprocessor 32 first compares the pressure in foot sleeve 4 to the pressure indicated by the level of the channel "A" reference pressure waveform signal. If the pressure in foot sleeve 4 exceeds the reference pressure by a pre-set limit of 10 mmHg, microprocessor 32 generates an alarm signal indicating over-pressurization of the sleeve connected to channel "A". If the pressure in foot sleeve 4 is less than the reference pressure signal by a pre-set limit of 10 mmHg, microprocessor 32 generates an alarm signal indicating under-pressurization of the sleeve connected to channel "A".

Microprocessor 32 also analyzes the channel "A" sleeve pressure signal generated by pressure transducer 26 representative of the pressure waveform being produced in foot sleeve 4, in order to measure predetermined waveform parameters. The specific waveform parameters measured by microprocessor 32 are determined by the reference values of the waveform parameters corresponding to the channel "A" reference pressure waveform signal. If for example, microprocessor 32 has retrieved from waveform register 56 a reference value for the maximum pressure applied during the cycle time period microprocessor 32 will analyze the sleeve pressure signal and measure the value of the maximum applied pressure during the cycle time period.

Microprocessor 32 computes the differences between the measured values of the waveform parameters and the corresponding reference values of the waveform parameters. If the absolute differences between the measured and reference values are less than predetermined maximum variation levels microprocessor 32 retrieves a channel 'A' interval time from interval timer 58 and stores this channel 'A' interval time along with other information as described below in a location in therapy register 60. Microprocessor 32 then generates a channel 'A' interval timer reset signal which is communicated to interval timer 58.

To generate pressure waveforms in calf sleeve 6 connected to channel "B" of instrument 2, microprocessor 32 operates in an equivalent manner to the operation of channel "A" as described above. Reference pressure waveforms and corresponding reference values of waveform parameters, interval times, alarm signals and valve control signals are produced independently of those produced for channel "A".

When instructed by an operator of instrument 2 through manipulation of controls 22, microprocessor 32 will initiate the sequential generation of pressure waveforms in foot sleeve 4 and calf sleeve 6 connected to channels "A" and "B". The timing of the sequential generation of pressure waveforms in sleeves 4 and 6 may be selected by the operator to be: a) the initiation of a pressure waveform cycle by channel "B" at a predetermined time following the initiation of a pressure waveform cycle by channel "A"; or b) the initiation of a pressure waveform cycle by channel "B" upon the pressure within foot sleeve 4 connected to channel "A" exceeding a predetermined pressure level; or c) the initiation of a pressure waveform cycle by channel "B" upon slope of the pressure waveform within foot sleeve 4 connected to channel "A" exceeding a predetermined slope threshold; or d) the initiation of a pressure waveform cycle by channel "B" upon the channel 'A' interval time exceeding a predetermined threshold.

When instrument 2 is operating to generate pressure waveforms sequentially in foot sleeve 4 and calf sleeve 6 connected to channels "A" and "B", the channel "B" interval time is computed and stored in therapy register 60 when the absolute values of the differences between the measured and reference values of both the channel "A" and channel "B" pressure waveform parameters are less than predetermined maximum variation levels. Microprocessor 32 then generates a channel 'B' interval timer reset signal which is communicated to interval timer 58.

Interval timer 58 shown in FIG. 2 maintains independent timers for channel 'A' and channel 'B'. In the preferred embodiment the timers are implemented as counters that are incremented every 100 ms. The rate at which the counters are incremented determines the minimum interval time that can be resolved. Microprocessor 32 communicates with interval timer 58 to read the current values of the counters and also to reset the counters. Interval timer 58 includes a battery as an alternate power source and continues to increment the counters during any interruption in the supply of electrical power from power supply 62 required for the normal operation of instrument 2.

Microprocessor 32 generates alarm signals to alert the operator of instrument 2, and patient receiving therapy from instrument 2, if an excessive interval has elapsed between the application of pressure waveforms having desired reference values of waveform parameters. Microprocessor 32 periodically retrieves from interval timer 58 the current values of the channel 'A' and channel 'B' interval timers, if an interval time value exceeds a predetermined maximum of 5 minutes microprocessor 32 will generate an alarm signal associated with either channel 'A' interval time or channel 'B' interval time.

Real time clock 64 shown in FIG. 2 maintains the current time and date, and includes a battery as an alternate power source such that clock operation continues during any interruption in the supply of electrical power from power supply 62 required for the normal operation of instrument 2. Microprocessor 32 communicates with real time clock 64 for both reading and setting the current time and date. Therapy register 60 shown in FIG. 2, records "events" related to the pressure waveforms generated in sleeves connected to channels "A" and "B" of instrument 2, and thereby related to the therapy delivered to a patient by the preferred embodiment. "Events" are defined in the preferred embodiment to include: (a) actions by the operator to initiate the generation of pressure waveforms in a sleeve, to suspend the generation of pressure waveforms in a sleeve, or to select a reference pressure waveform for generation in a sleeve (b) alarm events resulting from microprocessor 32 generating alarm signals as described above; and (c) interval time events resulting from microprocessor 32 determining the interval between the application of pressure waveforms having predetermined desired parameters.

Microprocessor 32 communicates with therapy register 60 to record events as they occur. Microprocessor 32 records an event by communicating to therapy register 60: the time of the event as read from real time clock 64, and a value identifying which one of a specified set of events occurred and which channel of instrument 2 the event is associated with as determined by microprocessor 32. Also, if the event relates to channel "A" of instrument 2, therapy register 60 records the values at the time of the event of the following parameters: the channel "A" waveform selection signal, the channel "A" sleeve pressure signal, the channel "A" reference pressure waveform signal and the channel "A" interval time. Alternatively, if the event relates to channel "B" of instrument 2, therapy register 60 records the values at the time of the event of the following parameters: the channel "B" waveform selection signal, the channel "B" sleeve pressure signal, the channel "B" reference pressure waveform signal and the channel "B" interval time.

Therapy register 60 retains information indefinitely in the absence or interruption of electrical power from power supply 62 required for the normal operation of therapy register 60.

Microprocessor 32, when directed by an operator of instrument 2 through manipulation of controls 22, subsequently displays, prints or transfers to an external computer the values associated with events stored in therapy register 60. For example, microprocessor 32 in response to an operator of instrument 2 manipulating controls 22 will retrieve from therapy register 60 all events associated with determining interval times and the corresponding information associated with those events. Microprocessor 32 will then tabulate the retrieved information and will present on graphic display 20 a display detailing the history of interval times between the application of pressure waveforms having desired reference parameters for channels 'A' and 'B' of instrument 2. Also for example, microprocessor 32 in response to controls 22 will calculate and present on graphic display 20 the elapsed time between a first event recorded in therapy register 60 and a second event recorded in therapy register 60 by computing the difference between the time at which the first event occurred and the time when the second event occurred.

Referring to FIG. 2, and as described above operator input is by means of controls 22. Signals from controls 22, arising from contact closures of the switches that comprise controls 22 are communicated to microprocessor 32.

Microprocessor 32 will, in response to generated alarm signals, alert the operator and patient by text and graphic messages shown on display panel 20 and by audio tones. Electrical signals having different frequencies to specify different alarm signals and conditions are produced by microprocessor 32 and converted to audible sound by loud speaker 66 shown in FIG. 2.

Power supply 62 provides regulated DC power for the normal operation of all electronic and electrical components within instrument 2.

II. Software

FIGS. 4, 5, 6 and 7, are software flow charts depicting sequences of operations which microprocessor 32 is programmed to carry out in the preferred embodiment of the invention. In order to simplify the discussion of the software, a detailed description of each software subroutine and of the control signals which the software produces to actuate the hardware described above is not provided. The flow charts shown and described below have been selected to enable those skilled in the art to appreciate the invention. Functions or steps carried out by the software are described below and related to the flow charts via parenthetical reference numerals in the text.

Figure 4:
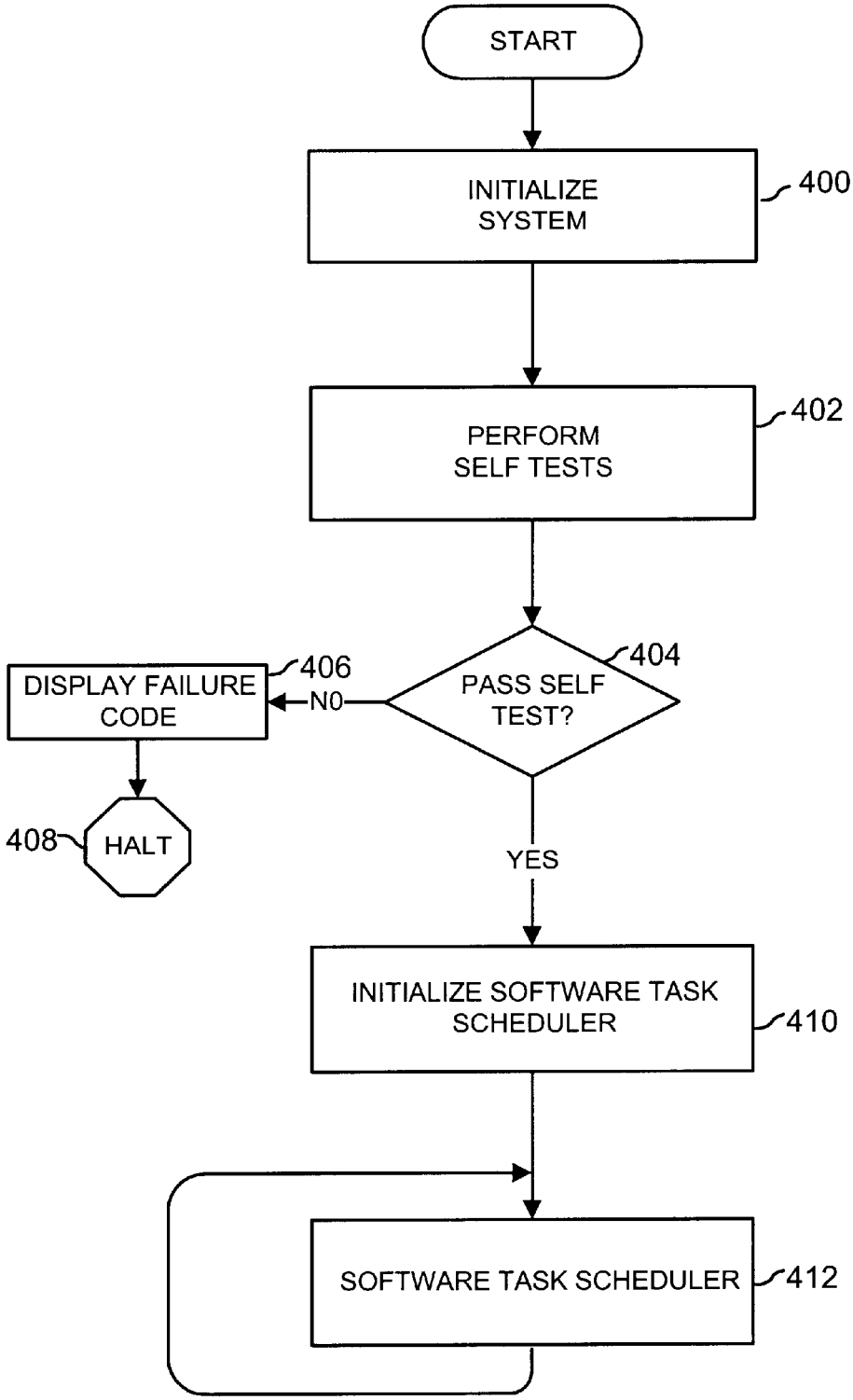
FIGS. 4, 5, 6 and 7 are software flow charts depicting sequences of operations carried out in the preferred embodiment.
Figure 5:
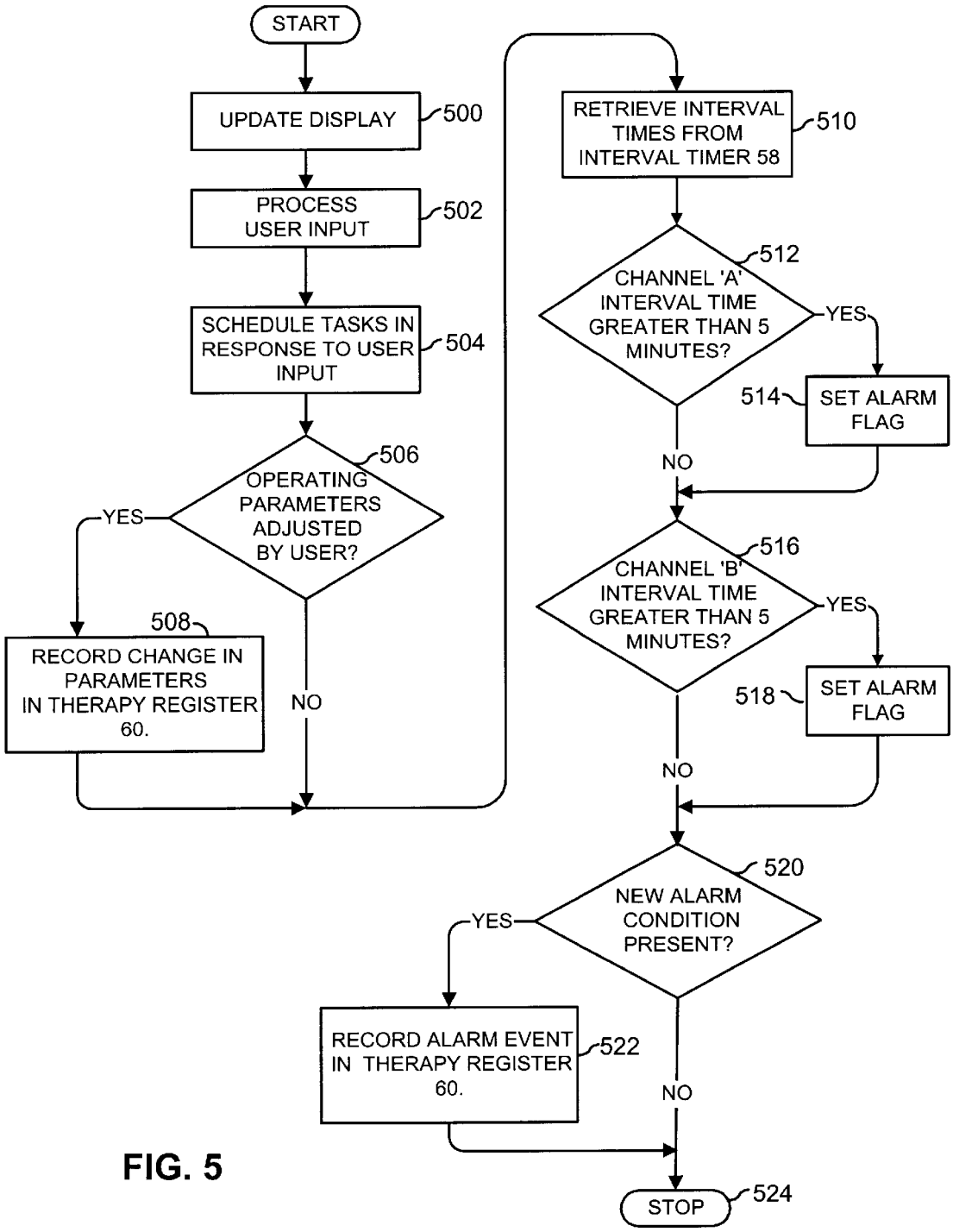
Figure 6:
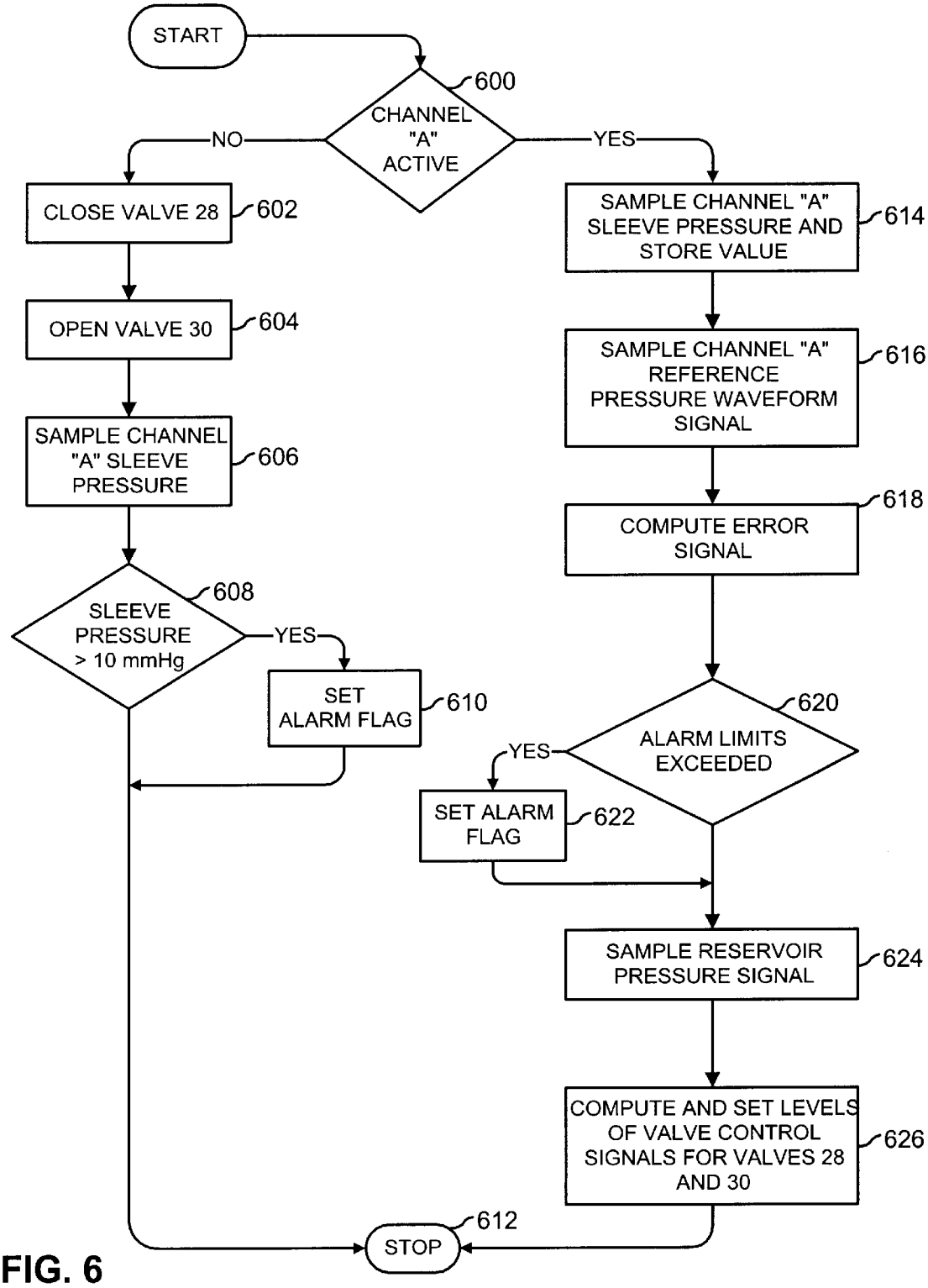
Figure 7:
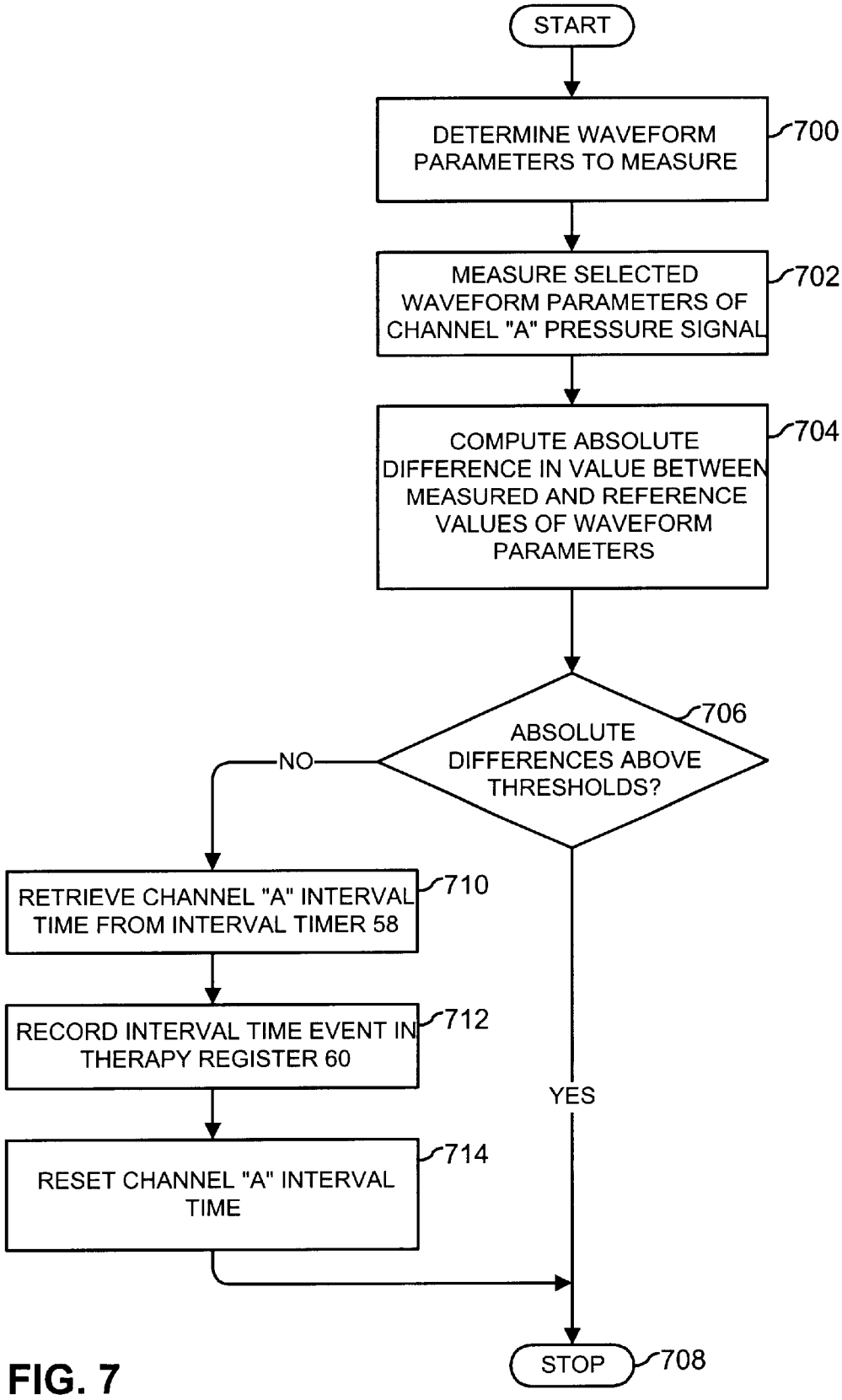

FIG. 4 shows the initialization operations carried out by the main program. FIG. 5 shows a software task associated with processing input from an operator and updating therapy register 60. FIG. 6 shows a software task for controlling channel "A" of instrument 2. FIG. 7 shows a software task associated with the determination of time intervals between the application of pressure waveforms having predetermined desired parameters.

FIG. 4 shows the initialization operations carried out by the system software. The program commences (400) when power is supplied to microprocessor 32 by initializing microprocessor 32 for operation with the memory system and circuitry and hardware of the preferred embodiment. Control is then passed to a self-test subroutine (402). The self-test subroutine displays a "SELF TEST" message on display panel 20 and performs a series of diagnostic tests to ensure proper operation of microprocessor 32. Should any diagnostic test fail (404), an error code is displayed on display 20 (406) and further operation of the system is halted (408); if no errors are detected, control is returned to the main program.

Next, a software task scheduler is initialized (410). The software task scheduler executes at predetermined intervals software subroutines which control the operation of instrument 2. Software tasks may be scheduled to execute at regularly occurring intervals. For example the subroutine shown in FIG. 6 and described below executes every 2 milliseconds. Other software tasks execute only once each time they are scheduled. The task manager (412) continues to execute scheduled subroutines until one of the following occurrences: a) power is no longer supplied to microprocessor 32; or b) the operation of microprocessor 32 has been halted by software in response to the software detecting an error condition.

FIG. 5 shows a flowchart of the software task associated with updating display 20, processing input from an operator and testing for interval time alarm conditions. This task is executed at regular predetermined intervals of 50 milliseconds. Control is first passed to a subroutine that updates the menus of commands and values of displayed parameters shown on display 20 (500). The menus of commands and parameters shown on display 20 are appropriate to the current operating state of instrument 2 as determined and set by other software subroutines.

Control is next passed to a subroutine (502) which processes the input from controls 22. In response to operator input by means of controls 22 other software tasks may be scheduled and initiated (504). For example, if the operator has selected a menu command to display the history of interval times between the application of pressure waveforms having desired reference parameters for channel 'A' software tasks will be scheduled to retrieve from therapy register 60 events associated with determining interval times and compute and display the history. The history of interval times may include the longest interval, and the cumulative total of all interval times between the application of pressure waveforms.

Control then passes to a subroutine (506) which determines if the operating parameters (reference pressure waveform selections, initiation or suspension of the application of pressure waveforms) of instrument 2 which affect the therapy delivered to a patient have been adjusted by an operator of instrument 2. Current values of operating parameters are compared to previous values of operating parameters. If the current value of any one or more parameters differs from its previously set value control is passed to a subroutine (508) for recording events in therapy register 60. This subroutine (508) records an event by storing the following in therapy register 60: the time of the event as read from real time clock 64; and a value identifying which one or more of a specified set of events occurred and which channel of instrument 2 the event is associated with as determined by subroutine (506). Also, if the event relates to channel "A" of instrument 2, the values of the following parameters at the time of the event are also stored in therapy register 60: channel "A" waveform selection signal, channel "A" sleeve pressure signal, channel "A" reference pressure waveform signal and channel "A" interval time. Alternatively if the event relates to channel "B" of instrument 2, the values of the following parameters at the time of the event are stored in therapy register 60: channel "B" waveform selection signal, channel "B" sleeve pressure signal, channel "B" reference pressure waveform signal and the channel "B" interval time.

As shown in FIG. 5 control is next passed to a subroutine (510) which retrieves from interval timer 58 the values of the interval times for channel "A" and channel "B" of instrument 2. If the channel "A" interval time is a above a predetermined threshold of 5 minutes (512) an alarm flag is set (514) to indicate that the channel "A" interval time has been exceeded. If the channel "B" interval time is above a predetermined threshold of 5 minutes (516) an alarm flag is set (518) to indicate that the channel "B" interval time has been exceeded.

Control is next passed to a subroutine (520) which compares the current alarm conditions to previous alarm conditions. If any one or more alarm conditions exist which did not previously exist, control is passed to a subroutine (522) for recording the alarm event in therapy register 60. Subroutine (522) records an alarm event by storing in therapy register 60 the time of the event as read from real time clock 64; a value identifying which one or more of a specified set of alarm events occurred as determined by subroutine (520). Also, if the alarm event relates to channel "A" of instrument 2, the values of the following parameters at the time of the event are also stored in therapy register 60: channel "A" waveform selection signal, channel "A" sleeve pressure signal, channel "A" reference pressure waveform signal and the channel "A" interval time. Alternatively if the event relates to channel "B" of instrument 2, the values of the following parameters at the time of the event are stored in therapy register 60: channel "B" waveform selection signal, channel "B" sleeve pressure signal, channel "B" reference pressure waveform signal and the channel "B" interval time. The software task shown in FIG. 5 then terminates (524).

FIG. 6 depicts a software task associated with controlling channel "A" of instrument 2. A similar software task exists for controlling channel "B", but for simplicity only the task associated with channel "A" will be described. The software task shown in FIG. 6 is scheduled to execute continuously once every two milliseconds. As shown in FIG. 6, if channel "A" is not currently generating pressure waveforms (600) in foot sleeve 4 the valve control signal for valve 28 is set to a level that ensures valve 28 remains closed (602). The valve control signal for valve 30 is set to a level that ensures valve 30 remains open (604). Opening valve 30 vents any gas in foot sleeve 4 connected to channel "A" to atmosphere, and closing valve 28 prevents gas from flowing from reservoir 36 to foot sleeve 4 connected to channel "A".

The channel "A" sleeve pressure signal is then sampled (606). If the pressure in foot sleeve 4 connected to channel "A" is above a predetermined threshold of 10 mmHg (608), an alarm flag is set (610) to indicate that the sleeve connected to channel "A' is pressurized at a time when it should not be pressurized. The software task associated with controlling channel "A" then terminates (612).

As shown in FIG. 6, if channel "A" is currently generating pressure waveforms (600) in foot sleeve 4, control is passed to a subroutine which samples the value of the channel "A" sleeve pressure signal (614). This subroutine (614) also stores the value in the memory of microprocessor 32 to permit microprocessor 32 to perform measurements of pressure waveform parameters as described further below. Control is then passed to a subroutine (616) which samples the channel "A" reference pressure waveform signal. The value of the sample obtained from the reference pressure waveform signal is representative of the desired sleeve pressure at the instant of time when the subroutine executes. An error signal is computed (618) by calculating the difference between the pressure indicated by the value of the channel "A" sleeve pressure signal and the value of the sample of the channel "A" reference pressure waveform signal. Control is passed to a subroutine (620) that compares the error signal to predetermined limits and sets an alarm flag (622) if the limits have been exceeded. Next, the signal from reservoir pressure transducer 52 is sampled (624). Control then passes to a subroutine (626) which calculates levels for the control signals for valve 28 and valve 30. The subroutine (626) uses the current levels of the error signal and reservoir pressure signal, as well as previously stored levels of these signals, to compute new levels for the valve 28 and 30 control signals. When the calculation subroutine (626) completes, the software task shown in FIG. 6 terminates (612).

FIG. 7 depicts the software task associated with the determination of the time intervals between the application of pressure waveforms having predetermined desired parameters. This software task is scheduled to execute periodically whenever channel "A" is generating pressure waveforms in foot sleeve 4. For simplicity only the software task associated with channel "A" has been shown in FIG. 7, a similar software task to the one shown in FIG. 7 is scheduled to execute periodically whenever channel "B" is generating pressure waveforms in calf sleeve 6.

As shown in FIG. 7 a subroutine (700) that determines which specific waveform parameters are to be measured is executed. This subroutine (700) uses the values of the reference waveform parameters corresponding to the channel "A" reference pressure waveform to determine which waveform parameters of the channel "A" pressure signal are to be measured. For example, if reference values for maximum pressure in a cycle period and the rate of rise of pressure during a portion of the reference waveform cycle time period are associated with the reference pressure waveform signal used in the production of pressure waveforms by channel "A"; the subroutine (700) will select these as the waveform parameters to be measured.

Control is next passed to a subroutine (702) which analyzes the channel "A" sleeve pressure signal and measures the values of the waveform parameters as selected by the previously executed subroutine (700). Control then passes to a subroutine (704) that calculates the absolute difference between the measured values of the pressure waveform parameters and the corresponding reference values for these parameters. If the absolute differences between the measured and reference values are above predetermined thresholds (706) the software task shown in FIG. 7 terminates (708). If the absolute differences between the measured and reference values are not above predetermined thresholds (706) the control is passed to subroutine (710)

This subroutine (710) retrieves the channel "A" interval time from interval timer 58. Next control is passed to a subroutine (712) which records in therapy register 60 an interval time event. The subroutine (712) stores in therapy register 60 the time of the event as read from real time clock 64 and a value identifying that an interval time event associated with channel "A" has occurred. The subroutine (712) also stores the values of the following parameters at the time of the event: channel "A" interval time, channel "A" waveform selection signal, channel "A" reference pressure waveform and channel "A" sleeve pressure signal.

As shown in FIG. 7 control next passes to a subroutine (714) which resets the interval timer associated with channel "A". The software task shown in FIG. 7 then terminates (708).

III. Sleeves

Figure 8:
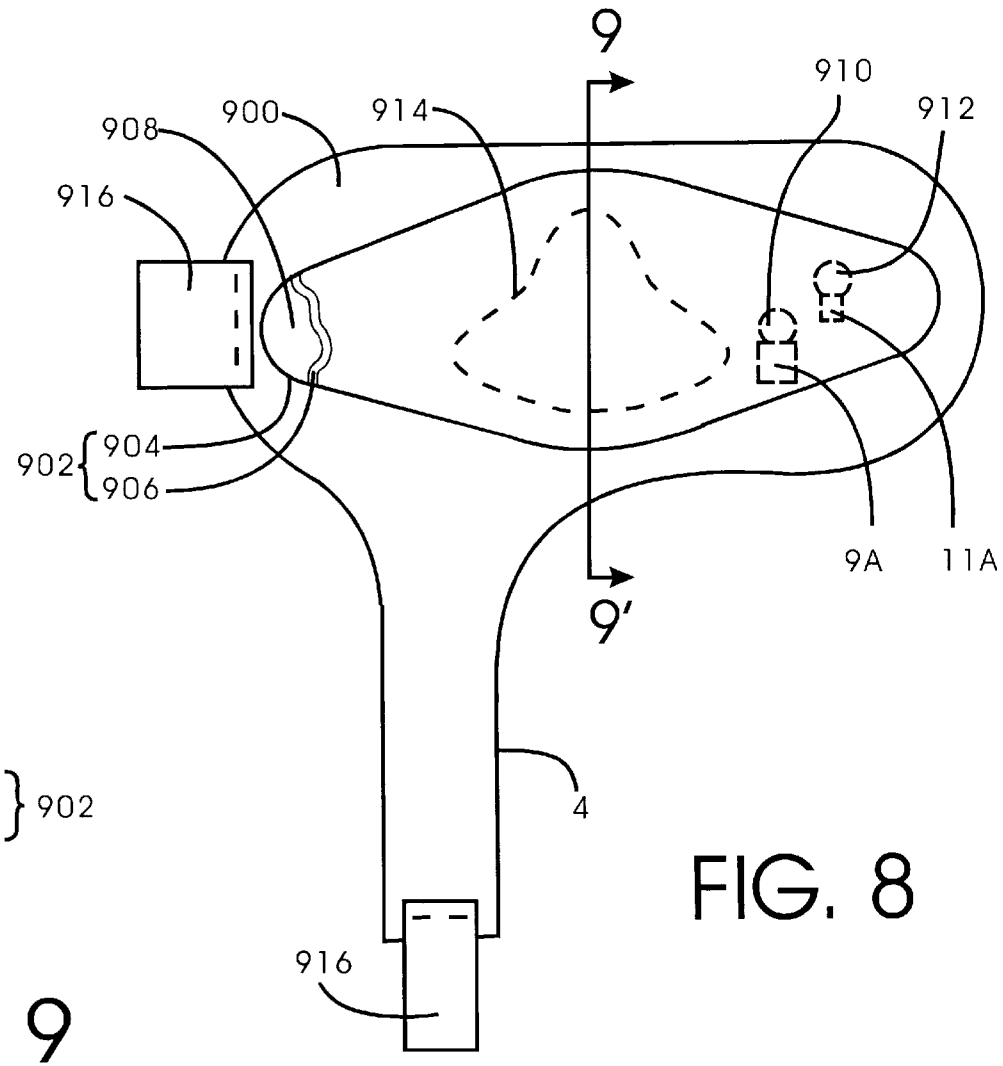
FIGS. 8 and 9 are pictorial representations of a sleeve for applying pressures to a patient's foot.

FIG. 8 is a plan view to illustrate details of foot sleeve 4. Foot sleeve 4 is manufactured in a single size designed to accommodate 95% of normal adult feet. Foot sleeve 4 includes exterior layer 900 which forms a non-inflating portion, and bladder assembly 902 which forms an inflating portion. Exterior layer 900 is fabricated from a synthetic cloth material and has an outer and inner surface which allows engagement with a Velcro™ hook material.

Figure 9:
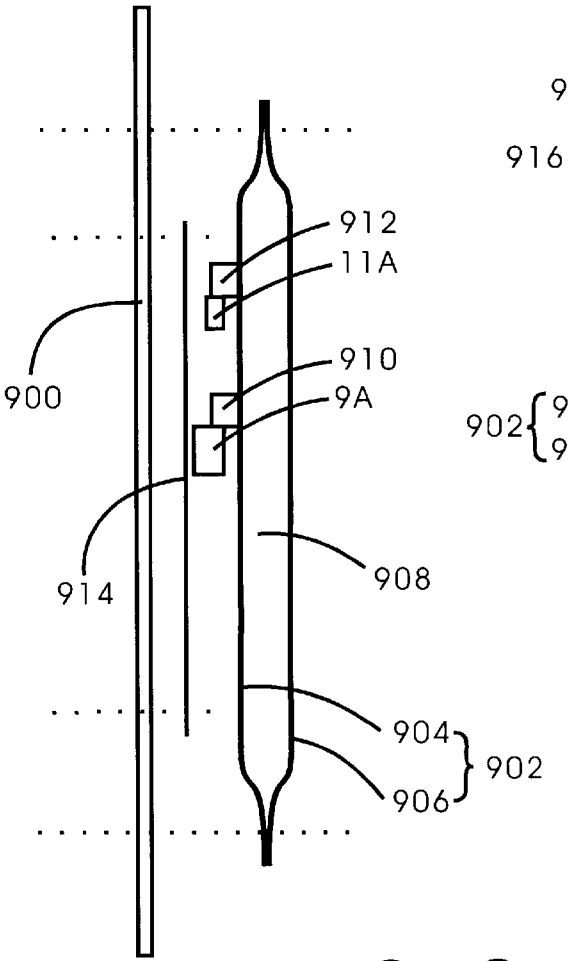

As shown in plan view FIG. 8 and cross sectional view FIG. 9, bladder assembly 902 contains layer 904 and layer 906. Layers 904 and 906 are fabricated from a flexible gas-impermeable thermoplastic polyvinylchloride sheet material permanently bonded together to form inflatable bladder 908. The flexibility of this gas-impermeable polyvinylchloride sheet material is predetermined and substantially inextensible when bladder 908 is pressurized up to 300 mmHg.

Ports 910 and 912 are thermoplastic right-angle flanges. Port 910, in combination with tubing 10 and connector 9, provides a pneumatic passageway suitable for increasing or decreasing the gas pressure within bladder 908 of foot sleeve 4. Port 912, in combination with pressure transducer 26, tubing 12 and connector 11, is used in the preferred embodiment to enable direct, accurate and continuous measurement of gas pressure in foot sleeve 4 by transducer 26. Such measurement will reflect the effects of variables such as the flow resistance of tubing 10, the flow resistance of connector 9, the design of foot sleeve 4, the pneumatic volume of the inflatable portion of foot sleeve 4 and the snugness of application of foot sleeve 4. Alternatively, it will be appreciated that direct, accurate and continuous measurement of pneumatic pressure within bladder 908 of foot sleeve 4 could be accomplished by embedding an electronic pressure transducer within bladder 908.

Referring to FIG. 8 and FIG. 9, stiffener 914 located between exterior layer 900 and bladder assembly 902, is permanently attached to layer 900. The shape of stiffener 914 is pre-determined being of sufficient width and length to cover the medial plantar vein of the foot. Stiffener 914 fabricated from a thermoplastic sheet material has a predetermined thickness and rigidity to direct the inflated portion of bladder 908 above stiffener 914 toward the limb producing the desired applied pressure waveform when bladder 908 is inflated.

As shown in FIG. 8, fasteners 916 attached to layer 900 consist of rectangular sections of Velcro™ hook material which removably engage with the cloth surface of layer 900 ensuring that foot sleeve 4 remains secured to a limb when bladder 908 is inflated.

Foot sleeve 4 is manufactured by die cutting layer 900 from the desired synthetic cloth material. Two holes are cut into layer 908 providing access for ports 910 and 912 allowing them to protrude through layer 900 when bladder assembly. 902 is secured in place. Stiffener 914, which is die cut from a thermoplastic sheet material into a predetermined shape, is then permanently heat sealed to layer 900 using Radio Frequency (RF) sealing equipment. Fasteners 916 are sewn to layer 900 such that the hooks of fasteners 916 face away from layer 900.

Fabrication of bladder assembly 902 begins by die cutting layers 904 and 906 from a flexible polyvinylchloride sheet material. Two holes are die cut into layer 904 allowing ports 910 and 912 to be inserted into position and bonded in place using RF sealing equipment. With ports 910 and 912 facing away from layer 906, layers 904 and 906 are heat sealed together forming bladder 908. With fasteners 916 facing ports 910 and 912 of bladder assembly 902, ports 910 and 912 are inserted into the holes in layer 900 such that ports 910 and 912 protrude through layer 900. Manufacturing of foot sleeve 4 is completed by permanently fastening bladder assembly 902 to layer 900 using RF sealing equipment and by inserting pneumatic connectors 9A and 11A into the opening of ports 910 and 912 respectively.

FIG. 1 illustrates foot sleeve 4 communicating pneumatically with instrument 2 by means of pneumatic connectors 9 and 11. As described above connector 9A is physically incompatible with connector 11B and does not mate with connector 11B. Connector 11A is physically incompatible with connector 9B and does not mate with connector 9B.

Figure 10:
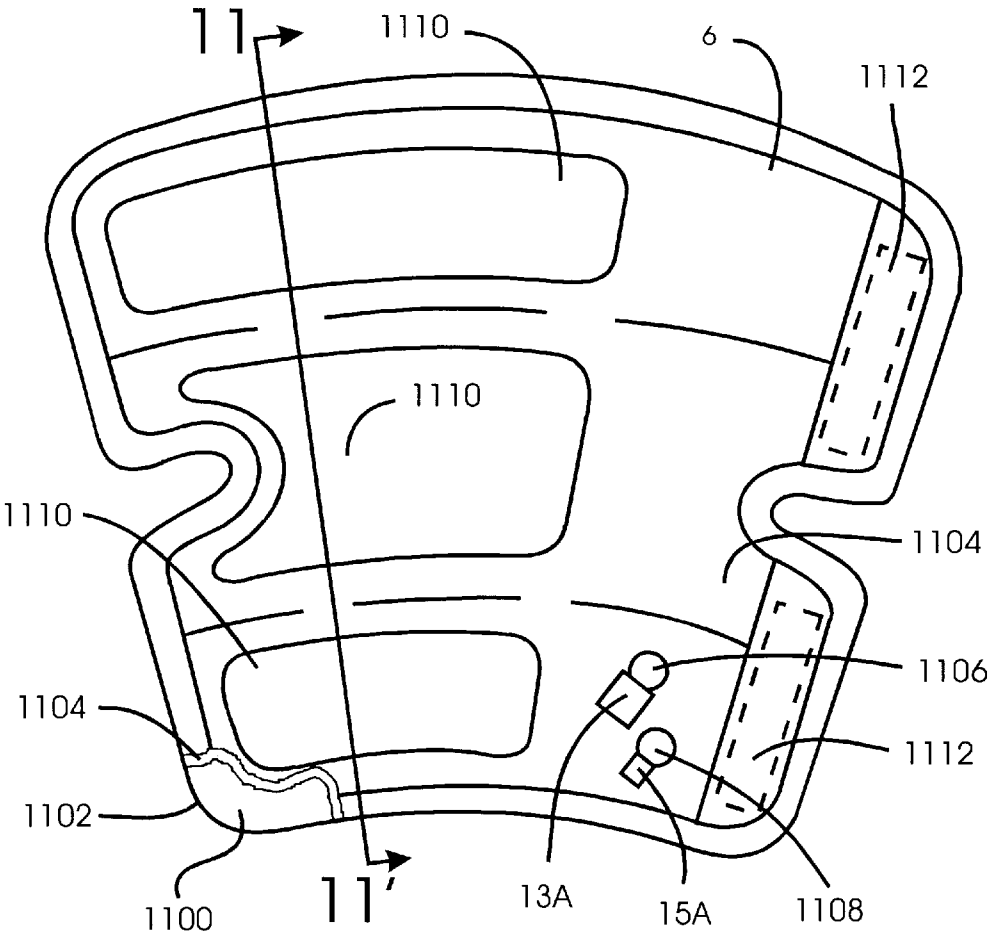
FIGS. 10 and 11 are pictorial representations of sleeve for applying pressures to a patient's calf.
Figure 11:
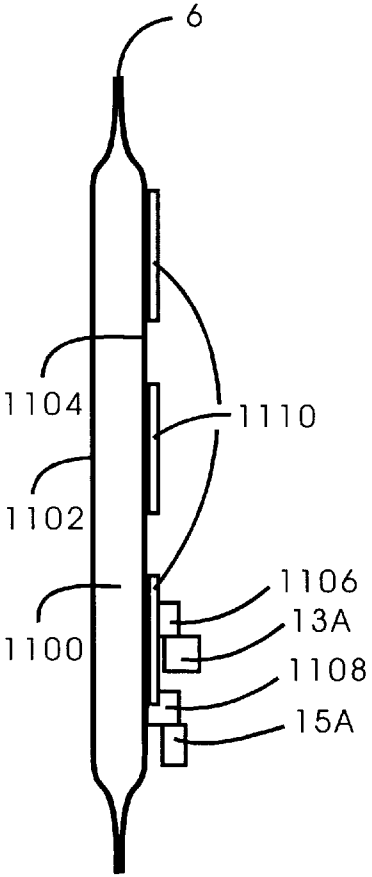

FIG. 10 is a plan view to illustrate details of calf sleeve 6. Calf sleeve 6 is manufactured in a single size designed to conform to a variety of calf shapes and sizes accommodating 95% of the normal adult population. As illustrated in plan view FIG. 10 and cross sectional view FIG. 11, calf sleeve 6 includes bladder 1100 which forms an inflatable portion surrounded by and an non-inflatable portion. Bladder 1100 of calf sleeve 6 is formed by permanently bonded together layers 1102 and 1104 using Radio Frequency (RF) sealing equipment.

Layers 1102 and 1104 are fabricated from a flexible gas-impermeable thermoplastic polyvinylchloride sheet material. The rigidity and thickness of this gas-impermeable sheet material is predetermined allowing layers 1102 and 1104 to be substantially inextensible when bladder 1100 is pressurized up to 60 mmHg.

Ports 1106 and 1108 are thermoplastic right-angle flanges. Port 1106, in combination with tubing 14 and connector 13, provides a pneumatic passageway suitable for increasing or decreasing the gas pressure within bladder 1100 of calf sleeve 6. Port 1108, in combination with pressure transducer 44, tubing 16 and connector 15, is used in the preferred embodiment to enable direct, accurate and continuous measurement of gas pressure in calf sleeve 6 by transducer 44. Such measurement will reflect the effects of variables such as the flow resistance of tubing 14, the flow resistance of connector 13, the design of calf sleeve 6, the pneumatic volume of the inflatable portion of calf sleeve 6 and the snugness of application of calf sleeve 6. Alternatively, it will be appreciated that direct, accurate and continuous measurement of pneumatic pressure within bladder 1100 of calf sleeve 6 could be accomplished by embedding an electronic pressure transducer within bladder 1100.

Shown in FIG. 10, Velcro™ loop fasteners 1110 and Velcro™ hook fasteners 1112 removably engage each other allowing application and removal of calf sleeve 6. Fasteners 1110 and 1112 ensure that calf sleeve 6 remains secured a limb when bladder 1100 is inflated. Velcro™ loop fasteners 1110 and Velcro™ hook fasteners 1112 have a thermoplastic coating on one side allowing loop fasteners 1110 to be bonded to the outer surface of thermoplastic layer 1104 and hook fasteners 1112 to be bonded to the outer surface of thermoplastic layer 1102.

Calf Sleeve 6 is manufactured by die cutting layers 1102 and 1104 from a polyvinylchloride thermoplastic sheet material. Two holes are die cut into layer 1104 providing access for ports 1106 and 1108. Ports 1106 and 1108 are inserted through the holes in layer 1104 and bonded to layer 1104 using RF sealing equipment. Velcro™ loop fasteners 1110 are permanently RF sealed to the outer surface of layer 1104 by positioning the thermoplastic coating on fasteners 1110 in contact with thermoplastic layer 1104.

With ports 1106 and 1108 facing away from layer 1102, layer 1104 and layer 1102 are RF sealed together forming bladder 1100. Hook fasteners 1112 are then RF sealed to the outer surface of layer 1102 as illustrated in FIG. 10. Manufacturing of calf sleeve 6 is completed by inserting pneumatic connectors 13A and 15A into the opening of ports 1106 and 1108 respectively.

FIG. 1 illustrates calf sleeve 6 communicating pneumatically with instrument 2 by means of pneumatic connectors 13 and 15. As described above connector 13A is physically incompatible with connector 15B and does not mate with connector 15B. Connector 15A is physically incompatible with connector 13B and does not mate with connector 13B.

We claim:

1. Apparatus for applying pressure waveforms to a patient's limb in order to augment venous blood flow in the limb and for monitoring the applied pressure waveforms, comprising:

an inflatable sleeve adapted for positioning onto a limb to apply a pressure to the limb beneath the sleeve when inflated with gas;

pressure transducing means for measuring the pressure of gas in the sleeve and for producing a sleeve pressure signal indicative of the measured pressure;

pressure waveform application means responsive to the sleeve pressure signal and a reference pressure waveform signal and operable by supplying gas to the sleeve at a pressure near a pressure indicated by a reference pressure waveform;

waveform register means for producing a succession of reference pressure waveform signals, each indicative of a reference pressure waveform during a predetermined cycle time period, and for storing a set of waveform parameters that correspond to the reference pressure waveforms, wherein the amplitude of each reference pressure waveform signal at any time within the predetermined cycle time period is indicative of the amplitude of the reference pressure waveform at the time;

waveform parameter measurement means for periodically measuring at least one value of a waveform parameter of the pressure applied by the sleeve and corresponding to one of the set of waveform parameters and for producing waveform parameter signals indicative of the measured values of the waveform parameter;

interval measuring means for producing an interval signal indicative of a time interval between a first occurrence when the measured value of the parameter is near a predetermined parameter level and the next occurrence when the measured value of the parameter is near the predetermined parameter level; and a register for storing the interval signal for later retrieval and display.

2. The apparatus of claim 1 wherein the waveform register means further produces a succession of reference pressure waveform signals and wherein the pressures indicated by the reference pressure waveform signals correspond to a plurality of reference pressure waveforms repeated periodically at repetition time periods equivalent to the cycle time period.

3. The apparatus of claim 1 wherein the inflatable sleeve includes a first sleeve connector means communicating pneumatically with the inflatable sleeve and a second sleeve connector means communicating pneumatically with the inflatable sleeve and wherein the first sleeve connector means does not communicate pneumatically with the second sleeve connector means except through the sleeve;

wherein the pressure waveform application means includes a pressure waveform application connector for connecting to the first sleeve connector means so that the pressure waveform application means communicates pneumatically with the sleeve, and wherein the pressure transducing means includes a pressure transducing connector for connecting to the second sleeve connector so that the pressure transducing means communicates pneumatically with the sleeve and communicates pneumatically with the pressure waveform application means only though the sleeve.

4. The apparatus of claim 1 and including sequential compression means for producing a sequential compression signal after a predetermined time has elapsed in the cycle time period;

a second inflatable sleeve adapted to apply pressure to the limb at a second location when inflated with gas;

second pressure transducing means for measuring the pressure of gas in the second sleeve and for producing a second sleeve pressure signal indicative of the measured pressure in the second sleeve;

second pressure waveform application means responsive to the second sleeve pressure signal and a second reference pressure waveform signal and operable by supplying gas to the second sleeve at a pressure near a pressure indicated by a second reference pressure waveform;

second waveform register means for producing a second reference pressure waveform signal indicative of a second reference pressure waveform after the sequential compression signal is produced, wherein the amplitude of the second reference pressure waveform signal at any time is indicative of the amplitude of the second reference pressure waveform at the time;

second waveform parameter measurement means for measuring the value of a predetermined second pressure waveform parameter and for producing a second waveform parameter signal indicative of the measured value of the second pressure waveform parameter; and wherein the interval determination means is further responsive to the second waveform parameter signal and wherein the interval determination means produces the interval signal to be indicative of the interval between the first occurrence when the measured values of the first and second waveform parameters are near the predetermined first and second parameter levels respectively and the next occurrence when the measured values of the first and second waveform parameters are near the predetermined first and second parameter levels respectively.

5. The apparatus claim 1 and including alarm means for producing an alarm signal near an alarm time when the difference between the pressure indicated by the level of the sleeve pressure signal and the pressure indicated by the reference pressure waveform signal is greater than a predetermined pressure difference.

6. The apparatus of claim 5 and including therapy register means for recording the amplitudes of the sleeve pressure signal and the reference pressure waveform signal near the alarm time when the alarm signal is produced and for enabling an operator to determine at a time subsequent to the alarm time the sleeve pressure and the reference waveform pressure indicated by the levels of the sleeve pressure signal and the reference pressure waveform signal recorded near the alarm time.

7. The apparatus of claim 1 and including therapy register means for determining the difference between the pressures indicated by the amplitudes of the sleeve pressure signal and the reference pressure waveform signal at a selected time and for recording the selected time if the difference is greater than a predetermined pressure difference.

8. Apparatus for applying pressure to a patient's limb in order to augment venous blood flow in the limb and for monitoring the applied pressure, comprising:

pressurizing means for supplying a gas at a varying supply pressure;

an inflatable sleeve connectable to communicate pneumatically with the pressurizing means and adapted for positioning onto a limb to apply a varying pressure to the limb beneath the sleeve when inflated with the gas;

pressure transducing means for measuring the pressure of gas in the inflatable sleeve and for producing a sleeve pressure signal indicative of the measured level of pressure;

waveform parameter measurement means for measuring the value of a predetermined pressure waveform parameter of the pressure applied by the sleeve and, wherein the parameter is selected from a set that includes at least one of (a) a rate of pressure rise and (b) a threshold pressure value that must be exceeded for a predetermined period, and for producing a waveform parameter signal indicative of the measured value of the predetermined pressure waveform parameter; and interval measuring means for producing and storing for later retrieval and display an interval signal indicative of a time interval between a first occurrence when the measured value of the predetermined pressure waveform parameter is near a predetermined parameter level and the next occurrence when the measured value of the predetermined pressure waveform parameter is near the predetermined parameter level.

9. The apparatus of claim 8 wherein the pressure waveform parameter is a predetermined variation in the estimated level of pressure of gas in the sleeve that augments the flow of venous blood into the limb proximal to the sleeve from the limb beneath the sleeve.

10. The apparatus of claim 8 wherein the pressure waveform parameter is the maximum estimated level of pressure of gas in the sleeve during a period of time.

11. The apparatus of claim 8 wherein the pressure waveform parameter is the rate at which the estimated level of pressure of gas in the sleeve increases from a first level to a second level during a period of time.

12. The apparatus of claim 8 wherein the pressure waveform parameter is the time between an increase in the estimated level of pressure of gas in the sleeve above a predetermined pressure threshold level to a decrease in the estimated level of pressure of gas in the sleeve below the predetermined pressure threshold level.

13. The apparatus of claim 8 wherein the interval determination means includes clock means for determining the time when an occurrence is measured and is further operable by determining the difference between the times determined when the first and next occurrences are measured.

14. The apparatus of claim 8 wherein the interval determination means further produces an indication of the interval between the first occurrence and the next occurrence only if the interval is greater than a predetermined minimum interval.

15. The apparatus as described in claim 8 wherein the interval determination means further produces a plurality of interval signals indicative of a plurality of intervals wherein each of the plurality of intervals corresponds to the time between an occurrence when the measured value of the parameter is near the predetermined parameter level and the next occurrence when the measured value of the parameter is near the predetermined parameter level.

16. The apparatus of claim 15 and including computing means responsive to the plurality of interval signals for producing an indication of the longest interval.

17. The apparatus of claim 15 and including computing means responsive to the plurality of interval signals for producing an indication of the cumulative total interval corresponding to the sum of each of the plurality of intervals.

18. The apparatus of claim 8 and including alarm means responsive to the interval signal for producing an indication perceptible to a human when the interval exceeds a predetermined maximum interval.

19. The apparatus of claim 8 wherein the interval determination means further produces the interval signal only when absolute value of the difference between the measured value of the parameter and the predetermined parameter level is not greater than a maximum variation level.

20. The apparatus of claim 8 wherein the predetermined pressure waveform parameter and the predetermined parameter level are selectable by an operator from a plurality of predefined parameters and parameter levels.

21. The apparatus of claim 8 wherein the pressurizing means communicates pneumatically with the sleeve through tubing means, wherein the pressure transducing means communicates pneumatically with the sleeve, and wherein the pressure transducing means only communicates pneumatically with the pressurizing means through the sleeve.

* * * * *